US005487344A

United States Patent [19]

Hutchison

[11] Patent Number: 5,487,344

[45] **Date of Patent: *Jan. 30, 1996**

[54] BLOCK PALLET CONSTRUCTION USING CORRUGATED SHEET MATERIALS

[75] Inventor: Joel P. Hutchison, San Antonio, Tex.

[73] Assignee: Miriam M. Benson, San Antonio, Tex.

[ * ] Notice: The portion of the term of this patent shall not extend beyond the expiration date of Pat. No. 5,433,156.

[21] Appl. No.: 198,635

[22] Filed: Feb. 18, 1994

Related U.S. Application Data

[63] Continuation-in-part of Ser. No. 178,835, Jan. 7, 1994.

[51] Int. Cl.[6] ..... B65D 19/00

[52] U.S. Cl. ..... 108/51.3; 108/56.1

[58] Field of Search ..... 108/51.3, 51.1, 108/56.1, 56.3; 428/184, 185, 186

[56] References Cited

U.S. PATENT DOCUMENTS

| | | | |
|---|---|---|---|
| 2,444,184 | 6/1948 | Cahners | 108/51.1 |
| 2,691,500 | 10/1954 | Baumann | 108/56.3 X |
| 3,092,046 | 6/1963 | Davidson | 108/56.1 X |
| 3,096,224 | 7/1963 | Goldstein et al. | 428/186 |
| 3,407,758 | 10/1968 | Simkins | 108/51.3 |
| 3,425,367 | 2/1969 | Oravez | 108/51.3 |
| 3,434,435 | 3/1989 | Achermann et al. | 108/51.3 |
| 3,542,636 | 11/1970 | Wandel | 428/185 X |
| 3,861,326 | 1/1975 | Brown | 108/51.1 |
| 4,062,300 | 12/1977 | Real | 108/55.3 |
| 4,220,100 | 9/1980 | Palomo et al. | 108/51.1 |
| 4,647,063 | 3/1987 | Piringer et al. . | |
| 4,714,026 | 12/1987 | Yamaguchi et al. . | |
| 4,950,524 | 8/1990 | Hacker | 428/184 |
| 5,057,176 | 10/1991 | Bainbridge . | |
| 5,076,176 | 12/1991 | Clasen . | |
| 5,156,094 | 10/1992 | Johansson et al. . | |
| 5,197,396 | 3/1993 | Breezer et al. . | |
| 5,343,814 | 9/1994 | Pigott et al. | 108/51.1 X |

FOREIGN PATENT DOCUMENTS

| | | | |
|---|---|---|---|
| 494540 | 7/1992 | European Pat. Off. . | |
| 2458260 | 6/1976 | Germany | 428/184 |
| 4314504 | 12/1993 | Germany | 108/51.3 |

*Primary Examiner*—Laurie K. Cranmer
*Assistant Examiner*—Janet M. Wilkens
*Attorney, Agent, or Firm*—Richard C. Litman

[57] ABSTRACT

A block shipping pallet is constructed of multiple laminations of corrugated sheet material, with specific construction details providing advantages in strength and trueness of the completed pallet, and further advantages in the reduction of tooling and labor costs. The pallet comprises top and bottom sheets with a series of blocks formed of multiple laminations of corrugated sheet material sandwiched between. The top and bottom sheets, and particularly the intermediate blocks, may be sawn from stacks of plural laminations, thus precluding any requirement for costly dies and intensive labor. Asymmetrical corrugated sheets may be used with one side having a different weight than the other. By laminating two such sheets together with like weighted sides in contact, the tendency of such sheets to curve or warp due to the difference in side thickness is substantially eliminated. Different orientations of the corrugations or flutes of the sheets during lamination and assembly of the pallet, provide advantages in strength for specific applications. The pallet may be constructed of plural laminations of various corrugated sheet materials, such as paperboard or fiberboard, or plastic.

10 Claims, 4 Drawing Sheets

BLOCK PALLET CONSTRUCTION USING CORRUGATED SHEET MATERIALS

REFERENCE TO RELATED APPLICATION

This application is a continuation in part of the U.S. patent application Ser. No. 08/178,835 entitled, "Construction Of Pallets From Corrugated Sheet Material" by the same applicant, and filed on Jan. 7, 1994.

FIELD OF THE INVENTION

The present invention relates generally to shipping pallets used in the shipping industry, and more specifically to pallet construction comprising spaced apart top and bottom sheets separated by plural blocks, using corrugated cardboard, paperboard, plastic and/or other corrugated materials. Specific orientation of the corrugations or flutes of the material, and in laminating the corrugated sheets, provide advantages in the manufacture and use of the pallets.

BACKGROUND OF THE INVENTION

Traditionally, shipping pallets have been constructed of wood slats and/or runners or stringers of various dimensions. Such wood pallets are relatively costly, even though they are generally cheaply made of relatively poor quality wood. The hasty assembly and poor wood quality result in pallets which may rapidly become damaged to the point of being unusable. Moreover, such pallets are relatively heavy, resulting in additional shipping costs to the shipper, just for the weight and volume of the pallets themselves.

As a result, pallets formed of other materials have been developed, and in fact pallets constructed of corrugated cardboard have been known since the early '60's, if not earlier. However, the various pallets formed of corrugated materials have been deficient in areas of strength, durability, warping, and/or environmental concerns (e.g., difficulty in recycling), compared to the present invention.

The need arises for block pallets constructed of corrugated sheet material, having a plurality of spacer blocks sandwiched between a top sheet and a bottom sheet. The construction provides for specific orientation of the corrugations and laminations to provide additional strength and freedom from warping while in use. The materials used are preferably recyclable in order to provide further environmental advantages.

DESCRIPTION OF THE PRIOR ART

U.S. Pat. No. 4,647,063 issued to Robert Piringer et al. on Mar. 3, 1987 discloses a Lightweight Core For Laminate Constructions. Plural corrugated sheets laminated either flat folded or rolled are disclosed. The corrugated sheet used in the laminations includes a backing on only one side, which is desirable for flexibility, according to the disclosure. The present invention requires greater strength and rigidity, and hence utilizes corrugated material having opposite backing sheets to each side of the corrugated core.

U.S. Pat. No. 4,714,026 issued to Akio Yamaguchi et al. on Dec. 22, 1987 discloses a Pallet For Material Handling having upper and/or lower sheets (described as deck boards) formed of corrugated material, with folded rectangular tubular runners or stringers therebeneath. Another embodiment utilizes a plurality of rectangular pads set in specially cut upper and lower sheets. The pads and stringers each include plastic inserts for greater strength. The numerous folds and different materials result in a pallet construction requiring relatively costly equipment and/or labor, unlike the single type of material used in the construction of a pallet of the present invention.

U.S. Pat. No. 5,057,176 issued to William Bainbridge on Oct. 15, 1991 discloses a Method Of Forming Corrugated Paperboard Automotive Liner. The method bonds additional vapor barrier and sound dampening sheets to the corrugated layup, which has only a single ply between two corrugations. The present pallet provides for additional laminations using only corrugated sheet.

U.S. Pat. No. 5,076,176 issued to Hank A. Clasen on Dec. 31, 1991 discloses a Corrugated Cardboard Pallet formed of plural layers of corrugated cardboard. The construction is relatively complex, comprising base slats, spacer blocks, intermediate slats, and top slats, in addition to top and bottom sheets. The present invention provides only three basic components comprising a top sheet, spaced apart bottom sheet, and a plurality of spacer blocks sandwiched therebetween to thereby simplify manufacture and provide a stronger pallet with fewer joints. Moreover, while Clasen states that his provided corrugation orientation is optimal, this will only be true for a relatively narrow range of desired pallet applications. (The intermediate slat 24 of FIG. 3 of Clasen is particularly confusing, as it shows the ends of the corrugations or flutes of the laminations in two different planes.) The present invention provides alternative numbers of laminations and orientations of the corrugated sheets used in the pallet laminations, for greater versatility. Also, it is noted that Clasen specifically provides only a single corrugated sheet for the top and (optional) bottom platform, relying upon the multitude of slats for lateral strength and support of a load. The present invention provides for multiple laminations of top and bottom sheets, for greater strength and protection against penetration. In addition to the above, the specific orientation of the present pallet corrugated sheets relative to top and bottom during the lamination, provides advantages in reducing or eliminating component warping, not foreseen by Clasen.

U.S. Pat. No. 5,156,094 issued to Bengt Johansson et al. on Oct. 20, 1992 discloses a Load-Carrying Pallet Of Corrugated Cardboard comprising one or more corrugated laminations forming an upper sheet, with plural pads or feet formed of multiple corrugated laminations secured thereto. As no intermediate structure is disclosed, each of the pads must be relatively low and wide, in order to reduce shear stresses. The present pallet is of a more conventional configuration, providing for more standardized utility, by means of its structure. The Johansson et al. pallet is relatively light and requires a wire or plastic matrix reinforcement of the pads, and is unsuitable for larger and/or heavier objects due to the relatively thin upper sheet.

U.S. Pat. No. 5,197,396 issued to Harlon W. Breezer et al. on Mar. 30, 1993 discloses a Double Deck Plastic Pallet formed of plastic components and including an internal tubular metal frame. No corrugation or lamination of components is disclosed. The pallet essentially comprises upper and lower sheets which are sealed at their edges to each enclose a metal frame, which upper and lower sheets are spaced apart by a plurality of plastic posts and secured together by plastic mechanical fasteners. While the result is relatively durable, it is also very heavy and costly relative to the present invention.

Finally, European Patent No. 494,540 to Stone Container Corp. and published on Jul. 15, 1992 discloses a Shipping Platform Apparatus having somewhat the same appearance as that of the present invention, but comprising a substantially different structure. The device comprises upper and lower corrugated paperboard sheets which are spaced apart by a plurality of pylons but the pylons essentially comprise rolls or coils of corrugated material and include hollow centers. The bottom sheet is also perforated by a plurality of cuts to produce flaps which extend upward into the interiors of the hollow pylons unlike the present pallet invention, which uses adhesives exclusively for assembly. A review of the detailed description fails to disclose any specific orientation for the corrugations of the pylons; however, the drawing figures clearly show the corrugations as being oriented horizontally, rather than vertically, as in the present invention. The horizontal corrugation orientation of the pylons, along with their hollow centers, result in a substantial loss of compressive strength for the pylons and subsequent reduction in load capacity in comparison to the present pallet invention.

None of the above noted patents, taken either singly or in combination, are seen to disclose the specific arrangement of concepts disclosed by the present invention.

SUMMARY OF THE INVENTION

By the present invention, an improved construction of block pallets from corrugated sheet material is disclosed.

Accordingly, one of the objects of the present invention is to provide an improved block pallet of corrugated sheet material which is of sturdy yet relatively simple construction and requires no special dies or folding machinery for its manufacture.

Another of the objects of the present invention is to provide an improved block pallet which utilizes multiple laminations of corrugated sheet for the various structural components, with the corrugations or flutes of the sheets being oriented either parallel or perpendicular to one another and to those of other components, depending upon the structural requirements of the pallet.

Yet another of the objects of the present invention is to provide an improved block pallet which utilizes asymmetrical corrugated sheets, with the sheets each having different weights of paper disposed to each side of the central corrugated flutes, and further to provide a lamination of such sheets which substantially reduces or eliminates any warping or curvature of such sheets due to their asymmetrical nature.

A further object of the present invention is to provide an improved block pallet which provides an essentially standard configuration, thus providing substantial strength and durability in combination with the alternative materials used.

An additional object of the present invention is to provide an improved block pallet which may be constructed of various corrugated materials, such as corrugated paperboard or cardboard, as well as corrugated plastic sheet material.

Another object of the present invention is to provide an improved block pallet which in at least one embodiment, provides for pickup by a fork lift or the like from any of the four sides of the pallet.

Yet another object of the present invention is to provide an improved block pallet which generally comprises a top sheet and a bottom sheet, which sheets are spaced apart by a plurality of blocks formed of multiple laminations of corrugated material, and which the bottom sheet may include openings therein providing for the wheels of a pallet jack, if desired.

Still another object of the present invention is to provide an improved pallet which requires no mechanical fasteners for construction or assembly, but uses glues, adhesives and the like exclusively for construction and assembly.

A final object of the present invention is to provide an improved pallet for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
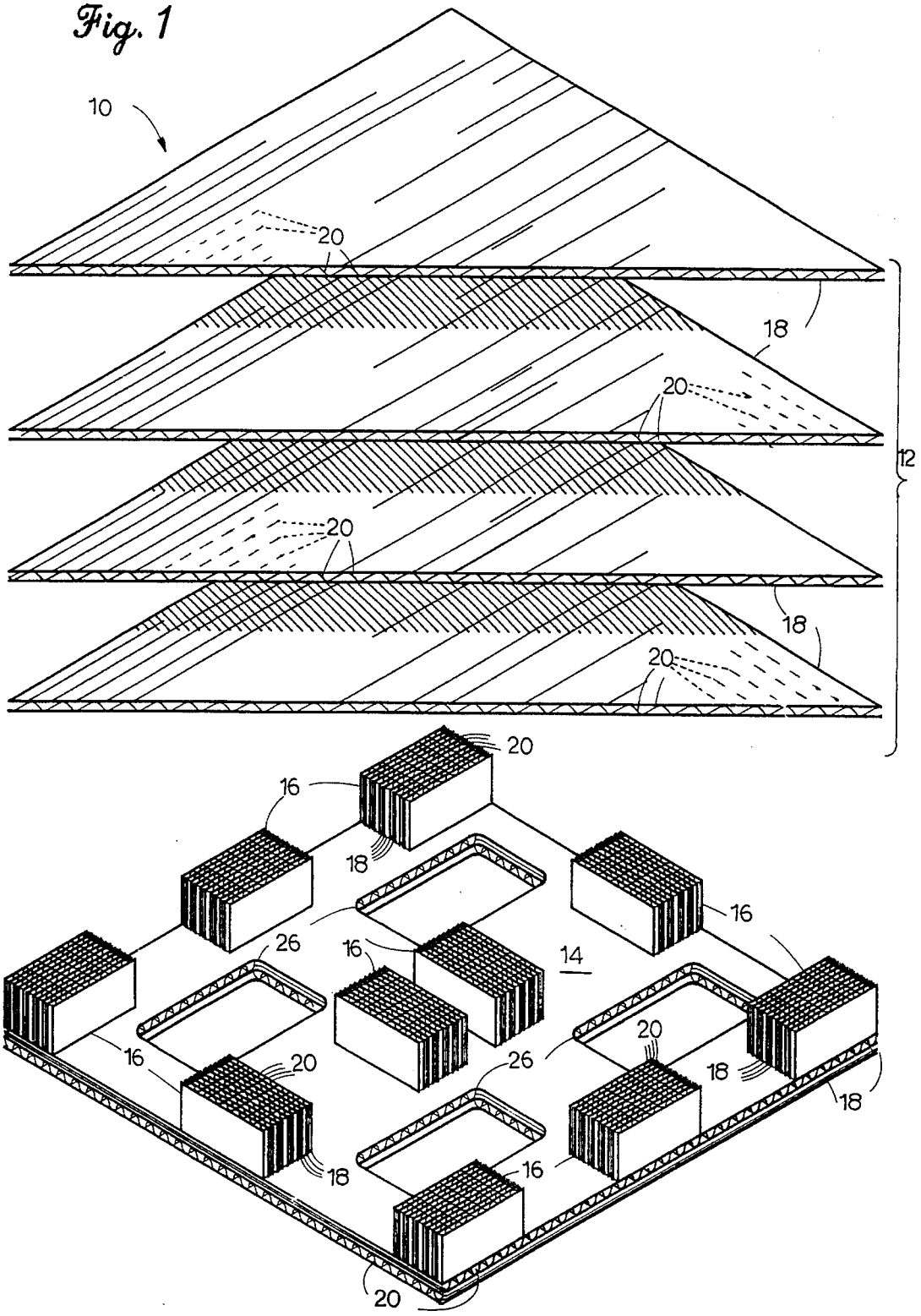
FIG. 1 is an exploded perspective view of a block pallet of the present invention, showing its general configuration and features.

Referring now particularly to FIG. 1 of the drawings, the present invention will be seen to relate to a block shipping pallet construction using laminated plural sheets of corrugated material. Pallet 10 includes a top sheet 12 and a bottom sheet 14, which sheets 12 and 14 are spaced apart by a plurality of blocks 16 sandwiched therebetween. However, each of the above components are formed of varying numbers of laminations of corrugated sheet material, adhesively secured together.

In the pallet 10 of FIG. 1, it will be seen that the top sheet 12 includes four corrugated sheets 18 with their corrugations or flutes 20 at alternating right angles to one another, in order to provide uniform stiffness of the top sheet 12 in all directions other top sheet 12 configurations may be used, as discussed further below. The bottom sheet 14 will be seen to comprise only two cross corrugated sheets 18 in FIG. 1, i.e., the corrugations 20 of the sheets 18 forming the bottom sheet 14 are at right angles to one another. The number of plies or sheets 18 used in the construction of the bottom pallet sheet 14, and their orientation to one another, is variable in the manner of the top pallet sheet 12 to provide a pallet 10 meeting desired specifications. The precise number of corrugated sheets, and their orientation, may be adjusted according to the required strength and anticipated loads for an individual pallet 10. The bottom sheet 14 may also include a plurality of openings 26, providing for the passage of the wheels of a pallet jack therethrough. Preferably, four openings 26 disposed in a generally rectangular array are provided; other opening 26 configurations may be used as desired.

The top sheet 12 and bottom sheet 14 are separated by a plurality of blocks 16, also formed of plural laminations of corrugated sheets 18, in the manner of the top and bottom pallet sheets 12 and 14 of FIG. 1. Blocks 16 are preferably constructed according to the example of FIG. 4, in which the corrugations 20 of each corrugated sheet 18 are mutually parallel. By installing such blocks 16 so that their corrugations or flutes 20 are oriented perpendicularly to the top and bottom pallet sheets 12 and 14, as shown in FIG. 1, the corrugations or flutes 20 effectively form a multitude of relatively small columns to provide relatively high compressive strength between the two pallet sheets 12 and 14. While other configurations may be used, the vertical flute orientation is preferred for relatively heavy pallet loads.

One problem with the assembly of multiple plies of sheet material is that often the sheets each have different properties, and when assembled the different properties result in the warping or curvature of the completed lamination. This problem may occur due to the properties of otherwise flat and uniform sheets of material when they are laminated, but often is due to the sheets themselves being warped or curved prior to laminating into multiple sheets. Nevertheless, it may be desirable to utilize sheets having different properties, e.g., two or more corrugated sheets of different thicknesses, and/or unsymmetrical sheets having different wall thicknesses or weights on each side of the corrugated core, as shown in FIG. 2A. For example, it may be desirable to provide a relatively thick wall sheet along the outer surface to resist puncture to a greater degree, while providing lighter core sheets having greater spacing as a filler; other requirements might result in entirely different assemblies or configurations.

Figure 2B:
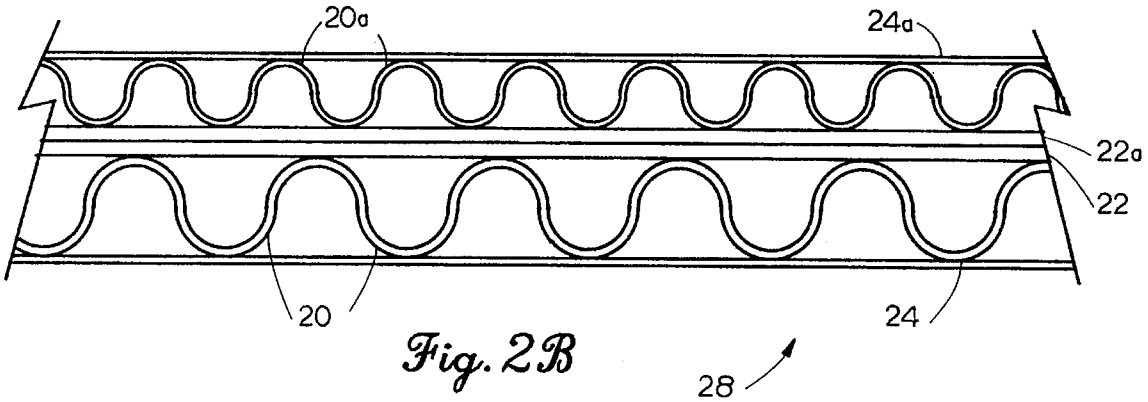
FIG. 2B is a side view in section of the corrugated sheets of FIG. 2A adhesively secured together to form a reverse lamination and substantially cancel the curvature or warping of the individual asymmetrical corrugated sheets.
Figure 2A:
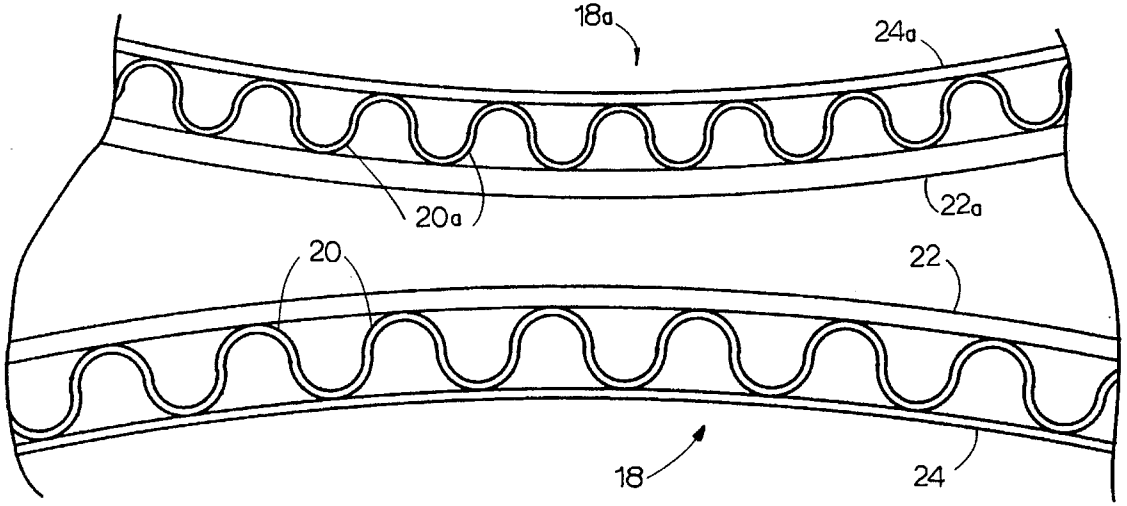
FIG. 2A is a side view in section of two mirrored asymmetrical corrugated sheets each having opposite walls of different weights or thicknesses, showing the warping or curvature inherent in such asymmetrical sheets.

The present invention includes means providing for the trueness or flatness of completed laminations using unsymmetrical sheets, as shown in FIGS. 2A and 2B. FIG. 2A discloses a first corrugated sheet 18, comprising a first outer wall sheet 22 having a relatively heavy weight, an opposite second outer wall sheet 24 having a lighter weight than the first sheet 22, with the two wall sheets 22 and 24 separated by a corrugated core 20. The second corrugated sheet **18*a* is formed similarly, with a heavy first outer wall sheet 22*a*, a lighter second outer wall sheet 24*a*, and a corrugated core 20*a*. Due to the heavier first outer wall sheets 22 and 22*a* respectively of the two corrugated sheets 18 and 18*a*, it will be seen that the two corrugated sheets 18 and 18*a*** have become warped.

When such warped sheets are laminated together with their curvatures and like sides facing the same direction, the warp or curvature will be "built in" to the resulting laminated plies. The resulting warped laminations are extremely difficult to work with, as it is nearly impossible to construct a pallet or other structure of laminated corrugated sheets, which is straight and true. Attempting to flatten or straighten such laminations after their formation can weaken the structure, thus removing much of the advantage of such multiple plies, and/or it can be difficult to form proper glue or adhesive joints between such warped components (e.g., between blocks 16 and a curved overlying top sheet 12), due to the difficulty in achieving complete contact between the two curved surfaces.

The present invention addresses this problem by assembling two such sheets with their like outer walls (e.g., 22 and **22*a*) facing one another, so the two corrugated sheets 18 and 18*a* are disposed in a "mirror image" to one another. Adhesive, glue, etc. is applied between the two sheets and pressure is applied (press, stacking, weights, etc.) during the adhesive curing process. The resulting reverse lamination 28, shown in FIG. 2B, causes any warping or curvature of the two individual corrugated sheets to be canceled, and a substantially flat reverse lamination results. The above process may be applied to any number of corrugated sheets to produce multiple laminations for any of the components used in the construction of the present block pallet. In addition, it will be seen that individual corrugated sheets 18 and 18*a* having differing corrugation thicknesses (e.g., a relatively thick sheet 18 and a relatively thin sheet 18*a***) may be used to form such reverse laminations, if desired, with much the same result.

Figure 3A:
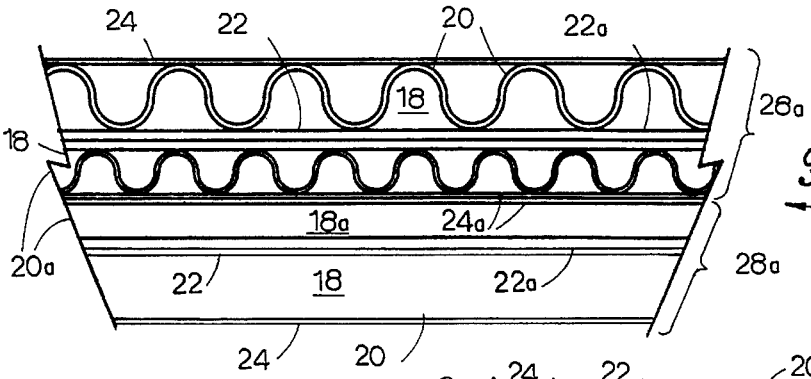
FIG. 3A is a partial edge view of a top or bottom pallet sheet formed of two cross corrugated laminations of two sheets each.

The pallet sheets **30*a* through 30*d* respectively disclosed in FIGS. 3A through 3D, provide applications of the above reverse lamination technique. In FIG. 3A, a pallet sheet 30*a* (usable as a top or bottom sheet) is formed of two reverse laminations 28*a* of two individual corrugated sheets 18 and 18*a* each of differing thicknesses, or a total of four sheets 18/18*a*. However, the two reverse laminations 28*a* will be seen to have their corrugations or flutes 20 disposed perpendicular to one another. The individual laminations 28*a* are substantially flat due to their reverse laminations, and when assembled together they provide substantially uniform bending strength in any direction across the assembly due to the perpendicular arrangement of the corrugations or flutes 20 of the two individual reverse laminations 28*a***.

Figure 3B:
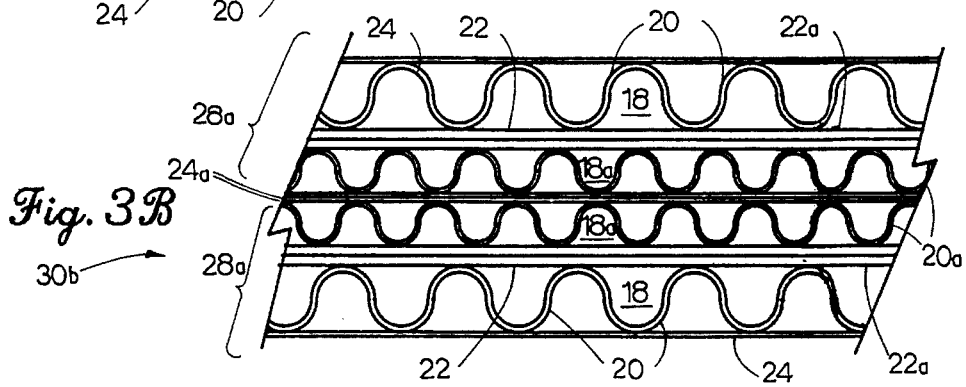
FIG. 3B is a partial edge view of a top or bottom pallet sheet formed of two reverse laminations of two sheets each.

Pallet sheet **30*b* of FIG. 3B is similar to the sheet 30*a* discussed immediately above, but will be seen to have the two reverse laminations 28*a* with their individual flutes 20 disposed parallel to one another. Such a configuration may be desirable under some circumstances where increased bending resistance is desired along a specific orientation of the sheet 30*b***.

Figure 3C:
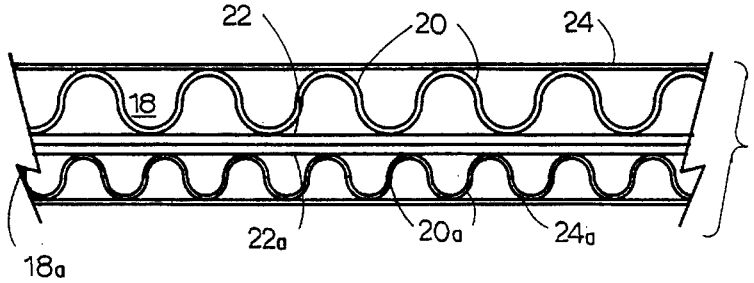
FIG. 3C is a partial edge view of a top or bottom pallet sheet formed of a single lamination of two corrugated sheets.

FIG. 3C discloses a single reverse lamination **28*a* comprising two individual corrugated sheets 18 and 18*a***, as in FIG. 2B. A top or bottom sheet formed of such a single reverse lamination might be desirable for a relatively lighter duty pallet application.

Figure 3D:
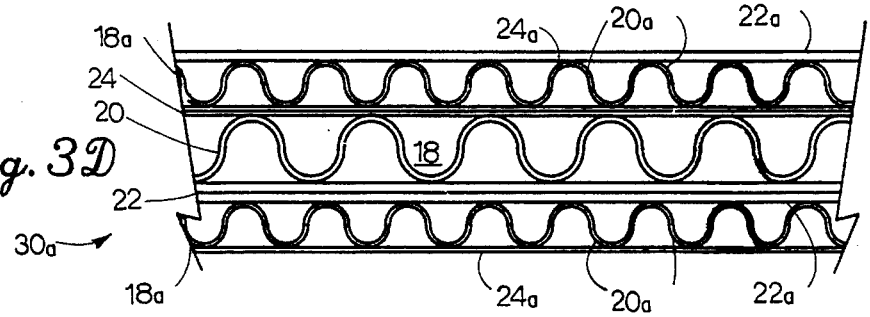
FIG. 3D is a partial edge view of a top or bottom pallet sheet formed of three corrugated sheets.

FIG. 3D discloses a pallet sheet formed of a single reverse lamination of two corrugated sheets 18 and **18*a*, with a third corrugated sheet 18*a* laminated thereto. While the pallet sheet of FIG. 3D shows two relatively thin corrugated sheets 18*a* and third relatively thick sheet 18 sandwiched therebetween, it will be understood that two thicker sheets 18 may be used to each side of a thinner sheet 18*a***, or that all sheets may be the same thickness. The specific arrangement is dependent upon the strength and stiffness desired for the completed layup for the pallet sheet, and can be configured as desired.

Figure 3E:
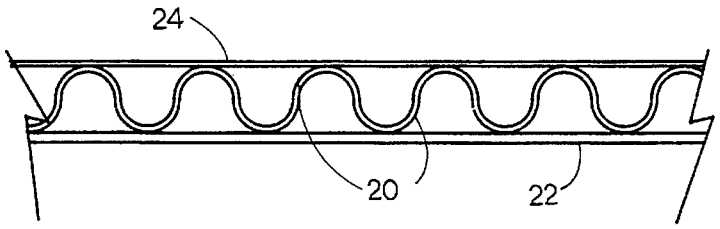
FIG. 3E is a partial edge view of a top or bottom pallet sheet using a single corrugated sheet of material.

FIG. 3E discloses a detail of a pallet sheet for relatively light duty, formed of a single corrugated sheet 18. A block pallet utilizing such a single corrugated sheet 18 for the top and bottom pallet sheets 12 and 14, would be limited to relatively light duty due to the relative weakness of such a single corrugated ply.

It will be seen that any of the above combinations of pallet sheets 30*a* through 30*d*, along with the single sheet 18 of FIGS. 2B and 3E, may be combined as needed for a specific application.

Figure 4:
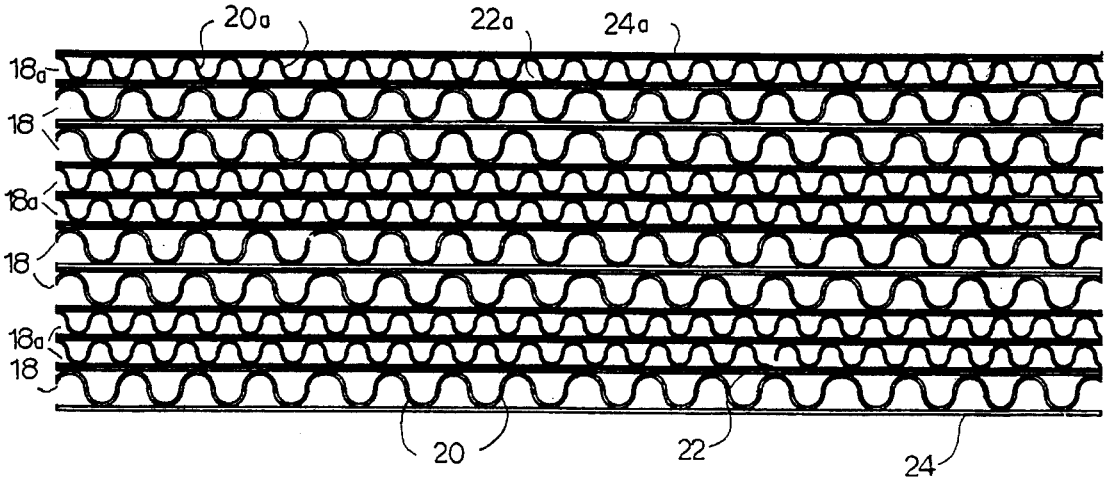
FIG. 4 is a top plan view of a section of a block used between the top and bottom sheets, showing its configuration of multiple plies of reverse laminated corrugated sheets.

FIG. 4 discloses a top plan view of an assembly of reverse laminations, as discussed in detail above, laminated together for use as intermediate blocks 16 sandwiched between the upper and lower sheets 12 and 14. While other combinations of laminations may be used, it has been found that the parallel, vertical orientation of the flutes or corrugations 20/20*a* is advantageous for the support of compressive loads, as in the case of a loaded block pallet 10. As in the case of the sheet 30*b*, plural reverse laminations 28*a* are used in order to substantially reduce or eliminate warpage of the completed block 16. It will be understood that the block 16 illustration of FIG. 4 may have fewer plies or corrugated sheets 18/18*a* therein than actually used in most applications; the illustration of FIG. 4 shows a reduced number of corrugated sheets (a total of ten) for clarity. In actual practice, 26 or more individual corrugated sheets 18/18*a* may be laminated together to form a relatively massive and thick sheet for cutting into a plurality of blocks 16.

The above disclosure will be seen to provide block shipping pallets 10, or of other configurations, formed of various configurations, arrangements and orientations of corrugated sheet material. The present block shipping pallets are particularly adaptable to construction from corrugated fiberboard or paperboard, either of virgin fiber or recycled material. However, other materials may also be used, e.g., virgin or recycled corrugated plastic sheet. The present block shipping pallets provide for ready disposal when they have deteriorated so they are no longer usable, as facilities exist virtually throughout the country at present for the recycling of such materials, unlike wood pallets.

The specific reverse lamination technique disclosed provides for the substantial elimination of warped sheets of materials and the accompanying problems incurred by such, including poor glue joints resulting from poor contact between adjacent sheets being glued, misalignment of components, etc. The reverse laminations may be assembled in virtually any orientation of corrugation plies, thus enabling the manufacturer to "tune" the strength of the present block shipping pallet as required for a specific purpose; such is not possible with wood pallets, other than by adjusting the thickness of the wood.

While the construction of the present pallets of multiple laminations of corrugated material provides numerous advantages, as discussed above, the general configuration of such pallets is preferably along the lines of earlier pallets of wood, known in the shipping industry. As such, no special handling or equipment modification is required. Standard fork lifts and other equipment can handle the present pallets with equal or greater facility as with earlier pallets, due to the relatively light weight of the present shipping pallets. The provision of at least four openings 26 in a rectangular array in the bottom sheet 14, provides for the lifting of the present block pallet 10 by means of a wheeled pallet jack from any of the four sides of the generally rectangular pallet 10, by wheeling the jack forks between the upper and lower sheets 12 and 14 until the wheels are resting directly upon the underlying surface, within the openings 26. The pallet jack may then be used normally to lift, support, and transport the present block pallet, with the pallet jack wheels extending through the lower sheet openings 26 and the jack forks supporting the upper sheet 12 therebeneath.

The present block shipping pallets thus require little in the way of costly tools and equipment to manufacture, other than means for applying pressure during the adhesive lamination of the individual corrugated sheets and saws or other cutting tools to shape the resulting laminations as required to form the various pallet components. No complex folding machines or other devices for applying mechanical fasteners or other devices are required. The result is an exceptionally cost effective shipping pallet, providing numerous advantages in shipping costs due to its light weight, low cost of manufacture, and ease of recycling.

It is to be understood that the present invention is not limited to the sole embodiments described above, but encompasses any and all embodiments within the scope of the following claims.

I claim:

1. A shipping pallet constructed of multiple laminates of corrugated sheet material and formed of components comprising:

a top sheet and a bottom sheet spaced apart from said top sheet, with said top sheet and said bottom sheet each comprising a plurality of corrugated sheets each having a first wall, a second wall, and a plurality of corrugation flutes disposed therebetween, said first wall of each of said corrugated sheets being of a heavier weight than said second wall; and a plurality of blocks sandwiched between said first sheet and said second sheet, with at least said blocks being constructed of plural reverse laminations of corrugated sheets, said corrugated sheets each having a first wall, a second wall, and a plurality of corrugation flutes disposed therebetween said first wall of each of said corrugated sheets being of a heavier weight than said second wall, with said first wall of one of said corrugated sheets being adhesively attached to said first wall of another of said corrugated sheets to provide a reverse lamination, whereby;

at least said blocks of said shipping pallet are substantially free from warps or curvature by means of said reverse lamination of said corrugated sheets used in the construction of said shipping pallet.

2. The shipping pallet of claim 1 wherein:

said plurality of corrugated sheets of said top sheet includes said plurality of corrugation flutes of at least one of said corrugated sheets being disposed perpendicularly to said plurality of corrugation flutes of at least one other of said corrugated sheets.

3. The shipping pallet of claim 1 wherein:

said plurality of corrugated sheets of said top sheet are constructed of plural reverse laminations of corrugated sheets, with said first wall of one of said corrugated sheets being adhesively attached to said first wall of another of said corrugated sheets to provide a reverse lamination of said top sheet.

4. The shipping pallet of claim 1 wherein:

said plurality of corrugated sheets of said bottom sheet includes said plurality of corrugation flutes of at least one of said corrugated sheets being disposed perpendicularly to said plurality of corrugation flutes of at least one other of said corrugated sheets.

5. The shipping pallet of claim 1 wherein:

said plurality of corrugated sheets of said bottom sheet are constructed of plural reverse laminations of corrugated sheets, with said first wall of one of said corrugated sheets being adhesively attached to said first wall of another of said corrugated sheets to provide a reverse lamination of said bottom sheet.

6. The shipping pallet of claim 1 wherein:

one of said corrugated sheets comprising said reverse lamination is thicker than another of said corrugated sheets.

7. The shipping pallet of claim 1 wherein:

said bottom sheet includes four pallet jack openings therethrough disposed in a substantially rectangular array, whereby said shipping pallet is lifted from any side by means of a pallet jack with pallet jack wheels which extend through said pallet jack openings of said bottom sheet.

8. The shipping pallet of claim 1 wherein:

said corrugated sheets are formed of fiber material.

9. The shipping pallet of claim 1 wherein:

said corrugated sheets are formed of plastic.

10. The shipping pallet of claim 1 wherein:

at least said blocks of said shipping pallet are each formed with said corrugation flutes disposed perpendicular to said top sheet and said bottom sheet.

* * * * *